US006311015B1

(12) United States Patent
Shih

(10) Patent No.: US 6,311,015 B1
(45) Date of Patent: Oct. 30, 2001

(54) CABLE COILING DEVICE FOR ELECTRIC HEATERS

(76) Inventor: Wen-Te Shih, No. 59, Yng Shiuh 2nd St., Yang Mei City, Taoyuan (TW)

( * ) Notice: Subject to any disclaimer, the term of this patent is extended or adjusted under 35 U.S.C. 154(b) by 0 days.

(21) Appl. No.: 09/722,560

(22) Filed: Nov. 28, 2000

(51) Int. Cl.[7] ..... F24H 3/00
(52) U.S. Cl. ..... 392/370; 219/200; 392/347
(58) Field of Search ..... 392/370, 347; 219/200, 211; 34/90, 96, 97

(56) References Cited

U.S. PATENT DOCUMENTS

| | | | | |
|---|---|---|---|---|
| 2,015,982 | * | 10/1935 | Witzel | 392/379 |
| 3,949,487 | * | 4/1976 | Bartram et al. | 34/99 |
| 4,420,678 | * | 12/1983 | Kalb | 219/521 |
| 4,517,757 | * | 5/1985 | Asada et al. | 219/256 |
| 5,351,417 | * | 10/1994 | Rubin | 34/90 |
| 5,784,800 | * | 7/1998 | Santhouse et al. | 34/97 |
| 5,857,263 | * | 1/1999 | Chan | 34/97 |

FOREIGN PATENT DOCUMENTS

| | | | |
|---|---|---|---|
| 459507 | * | 9/1968 | (CH) . |
| 3040640 | * | 5/1982 | (DE) . |
| 3-191258 | * | 8/1991 | (JP) . |
| 3-210205 | * | 9/1991 | (JP) . |

* cited by examiner

*Primary Examiner*—John A. Jeffery
(74) *Attorney, Agent, or Firm*—Rosenberg, Klein & Lee

(57) ABSTRACT

The present invention relates to an improved cable coiling device for electric heaters comprising a cable coiling frame being built in the casing at where the exit of the power cable locates; and an accommodating hood being disposed on the periphery of the coiling frame according to the casing appearance and such accommodating hood works with a linking member which turns the cable coiler on and off by lifting up the linking member to coil the power cable thereby the coiled cable will not be exposed and hence gives an artistic, reliable, convenient, and safe effect.

1 Claim, 10 Drawing Sheets

CABLE COILING DEVICE FOR ELECTRIC HEATERS

BACKGROUND OF THE INVENTION

1. Field of the Invention

The present invention relates to an improved cable coiling device for electric heaters, more particularly to a cable coiling device that hides the cable in such a way that the coiled cable will not be exposed and hence gives an artistic, reliable, convenient, and safe effect.

2. Description of the Prior Art

In the conventional way of coiling a power cable of an electric heater (as shown in FIG. 1), an exposed cable coiling frame 20 is disposed near the power cable outlet 101 of the casing 10, so that the power cable A is coiled and stored on the cable coiling frame 20. It is undeniable that the cable can be coiled and fixed in the position of the cable coiling frame that is disposed on the external side of the casing, and the value and performance that it offers. After years of practicing the prior art, the manufacturers and users realize that such conventional arrangement still has the following shortcomings:

1. The exposed cable coiling frame 20 definitely provides a means for collecting a cable A, but the coiled cable A is easily loosened or bears the risk of falling out if it is not securely tied to the cable coiling frame. Furthermore, it also has the shortcoming of not able to tie securely, stably, and artistically.
2. The exposed cable coiling frame 20, regardless of its situations of coiling or decoiling, gives an inharmonic, inartistic, and inconsistent feeling on the overall external appearance of the heater. Meanwhile, the exposed cable coiling frame may be collided or contacted by human body (especially our foot) that may endanger our safety.

Of course, other electric appliance manufacturers at present may use an automatic coiler to collect power cable. However, such automatic cable coiling devices may be very complicated in its structure, and hence may have a greater chance for breakdowns, and mostly important it occupies more space and requires a larger volume of the electric appliances, a more expensive manufacturing cost, and a higher selling price for consumers. Under the principle of pursuing better quality with lower price, the automatic cable coiling devices are limited in their uses and only selected for use depending on the special properties of the type, mode, and selectivity of the merchandise.

In view of the shortcomings and inconvenience of the prior art mentioned above, which are the subjects of improvements for a long time, hence the inventor of the present invention based on years of experience accumulated from the engagement in the related industry conducted extensive research to resolve the foregoing shortcomings and invented the present invention.

SUMMARY OF THE INVENTION

The primary objective of the present invention is to provide an improved structure of a cable collecting device for an electric heater, wherein such cable coiling frame being designed to be built in the outlet of the power cable and following the shape of the casing, and an accommodating hood being disposed on the external periphery, and the accommodating hood being operated with a triggering member for lifting to open and close the hood, thereby makes the cable collection very convenient and the cable will not be exposed loosened. It has the merits of being artistic and harmonic in appearance, and safely secured in position that it would not come off easily.

Another objective of the present invention is to provide a simple, easy-to-use, and convenient way to collect cables such that they could be hidden without being exposed. It attains the safety purpose since the hidden device helps to preventing the user from being injured by accidents.

To make it easier for our examiner to understand the objective of the invention, structure, innovative features, and performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DESCRIPTION OF THE PREFERRED EMBODIMENT

Figure 1:
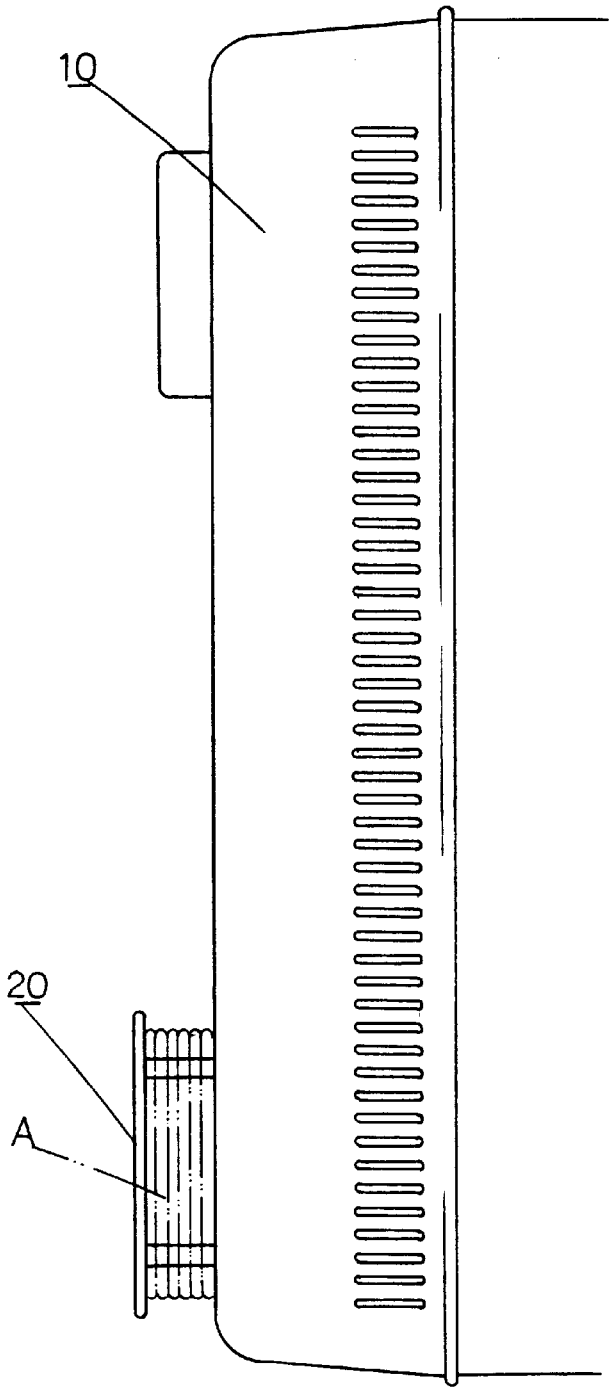
FIG.1 PRIOR ART
FIG. 1 shows a planar schematic diagram of cable collection of the traditional electric heater.
Figure 2:
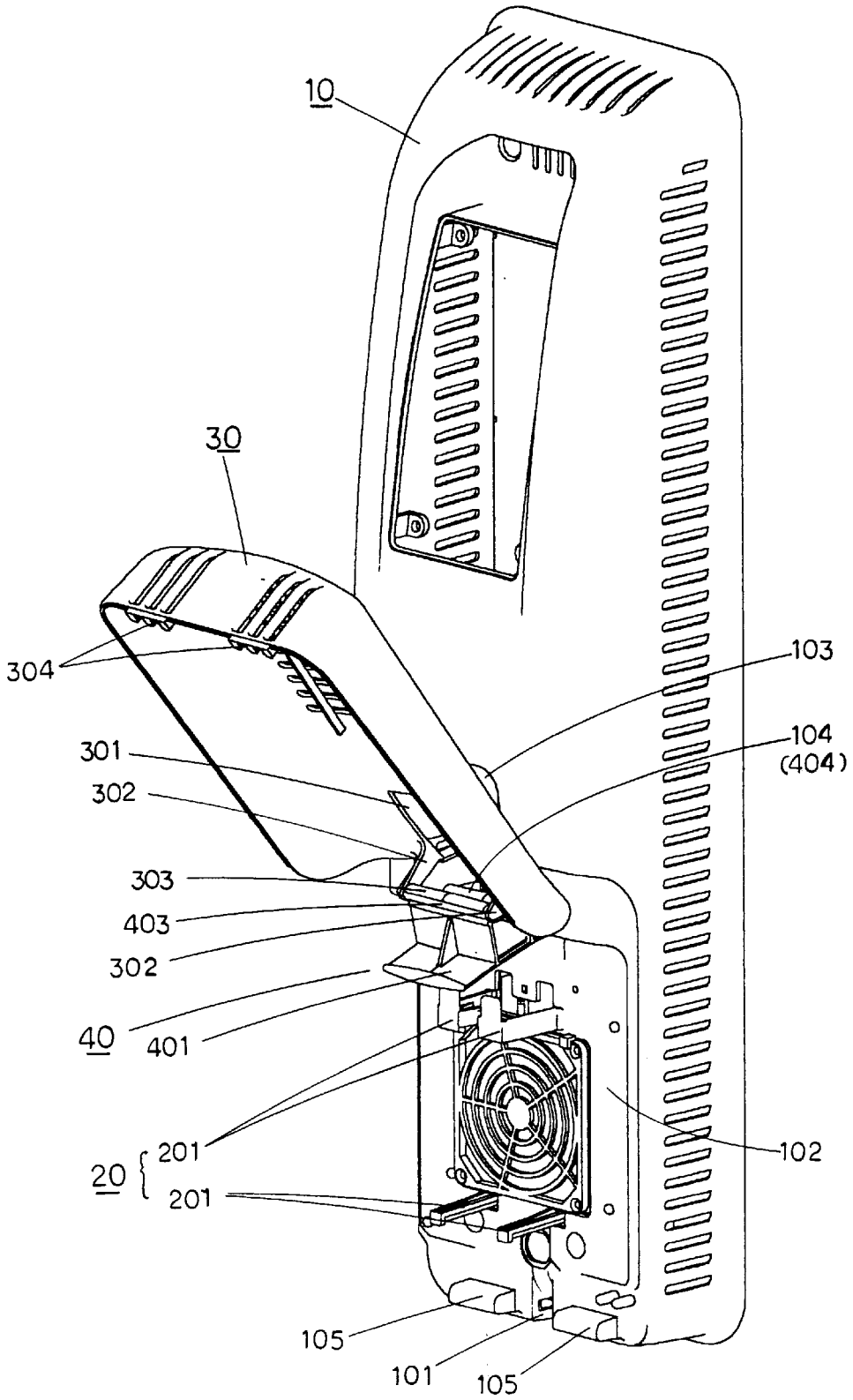
FIG. 2 shows a three-dimensional schematic diagram of the present invention.
Figure 3:
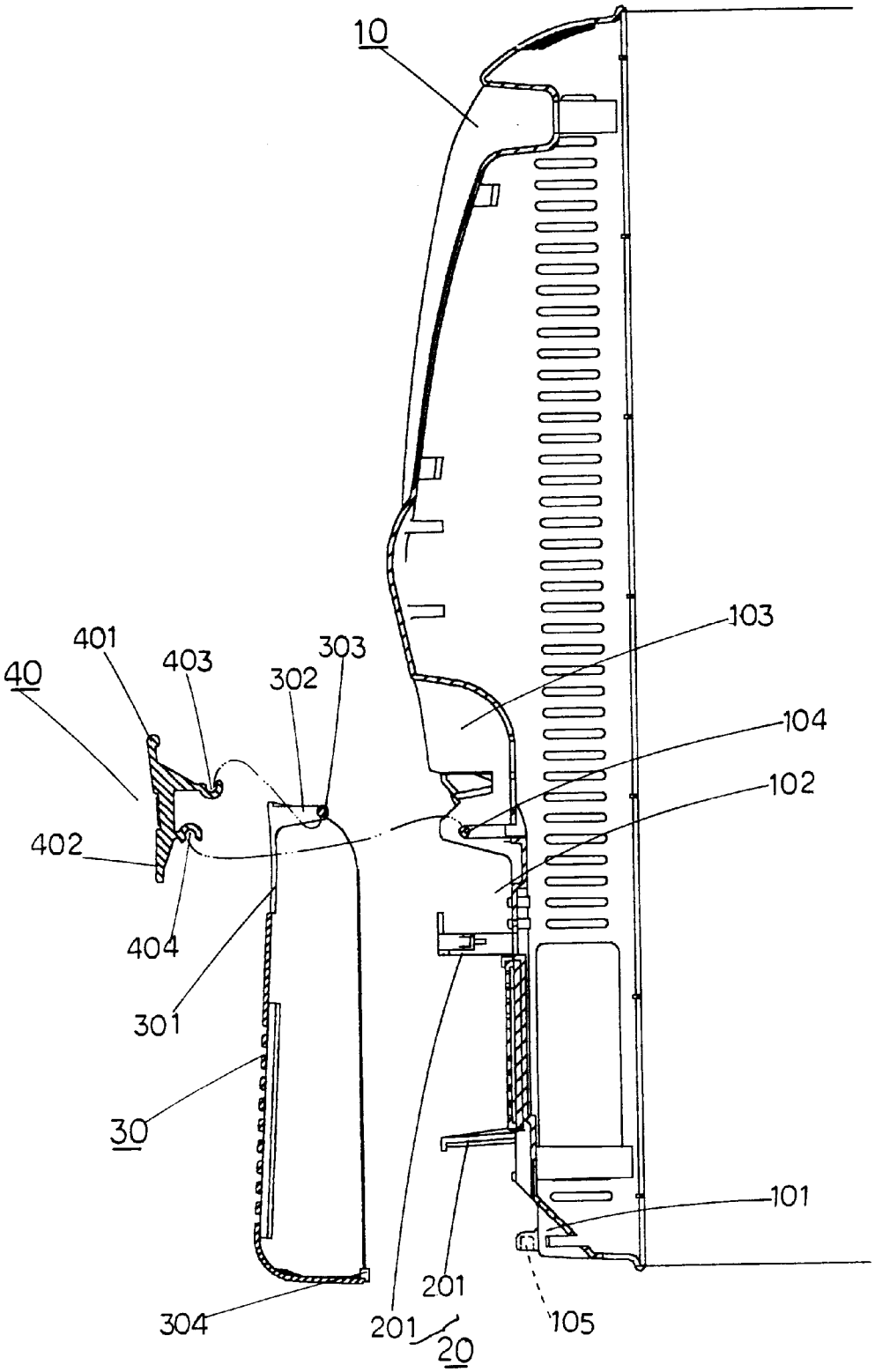
FIG. 3 shows a planar schematic diagram of the disassembled structure of the present invention.
Figure 4:
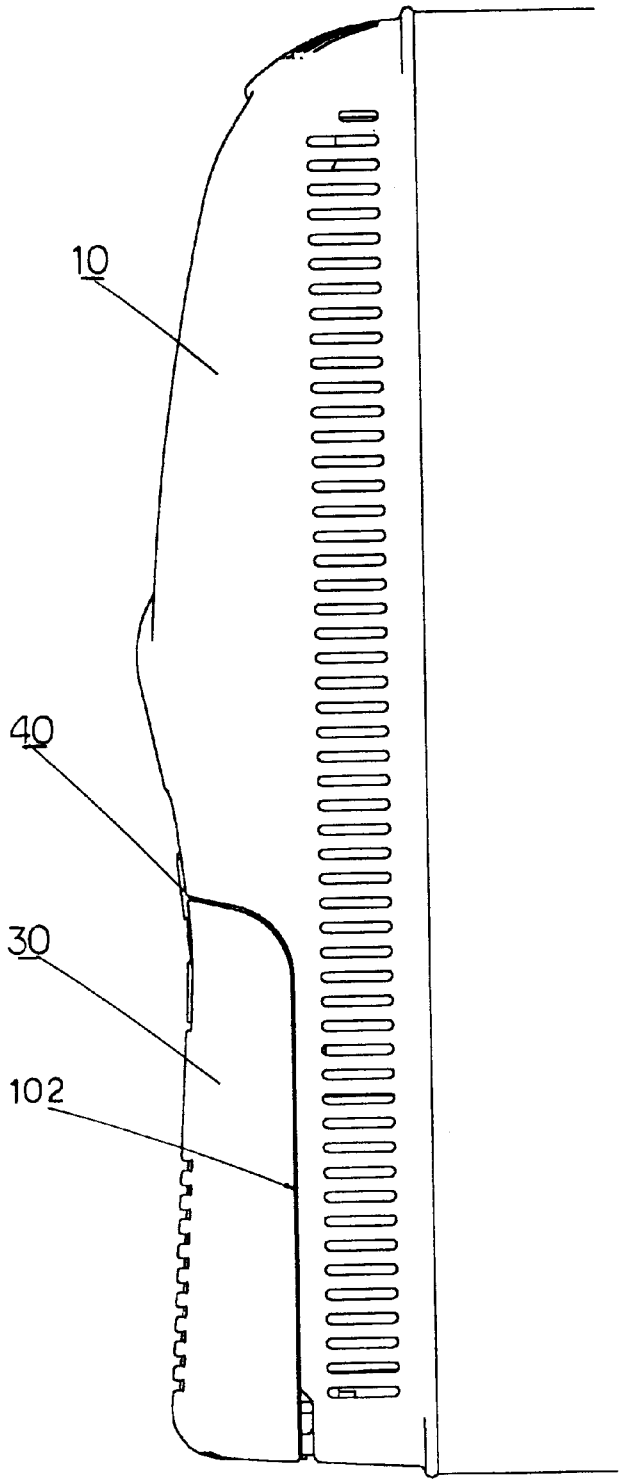
FIG. 4 shows a planar schematic diagram of the accommodating hood in closed position according to the present invention.
Figure 5:
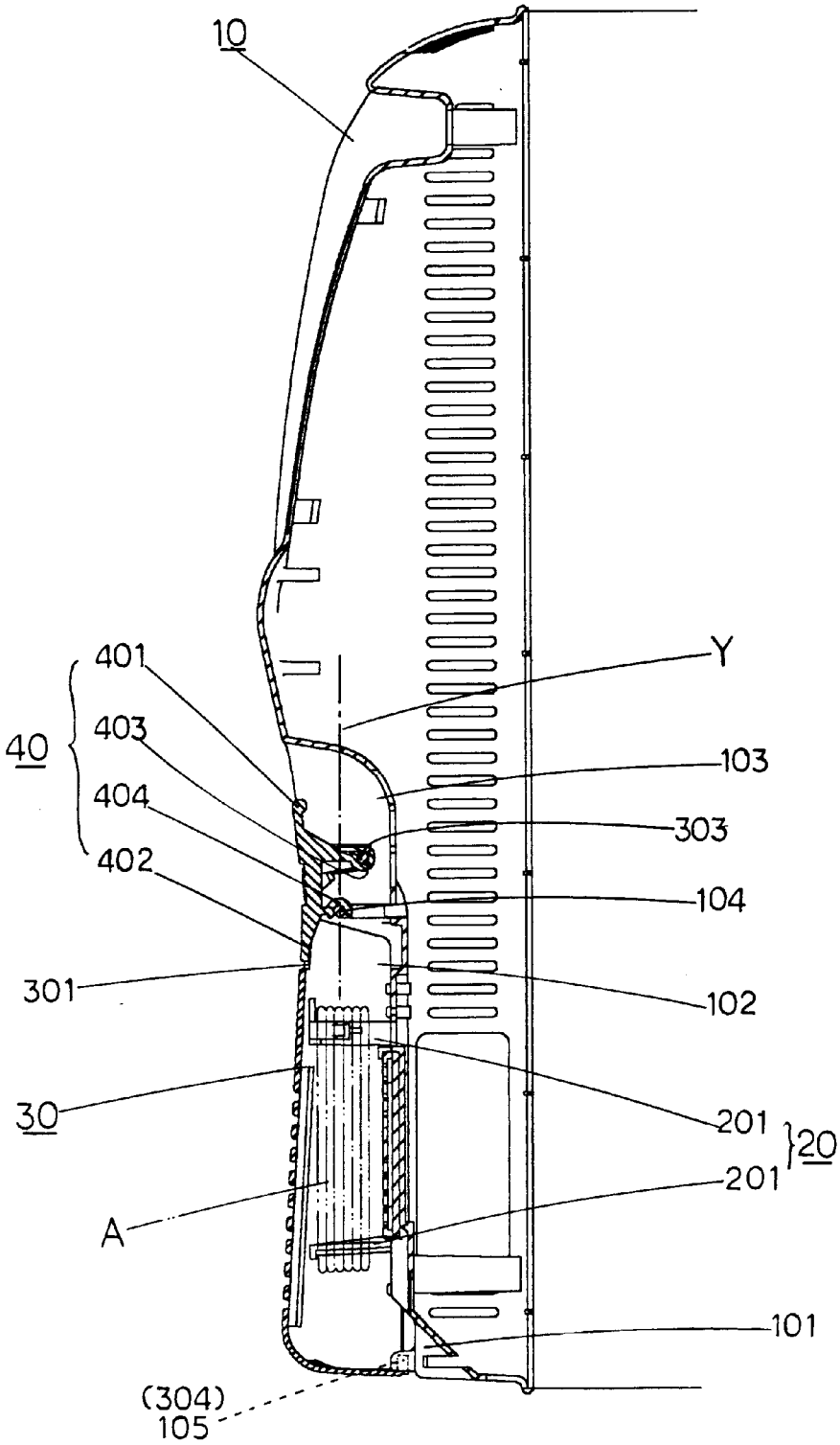
FIG. 5 is the cross-sectional schematic diagram of FIG. 4.

Firstly, please refer to FIGS. 2, 3, 4, and 5. It obviously shows that the improved cable collecting device of an electric heater mainly comprises an accommodating opening 102 having a concave recession being disposed at the outlet of the power cable of the casing, and a cable coiling frame composed of a plurality of supporting legs 201 being disposed at the center of the accommodating opening 102, and an accommodating hood 30 for exactly covering the accommodating opening 102 and following the shape of the casing 10, and a triggering member 40 for the coupling that is disposed between the casing 10 and the accommodating hood 30; wherein:

said casing 10 has an accommodating groove 103 being disposed at the upper middle and extended upwards at the coupling position of the accommodating opening 102 and the accommodating groove 103, and a transversal axial rod 104, and furthermore, at least one latch groove 105 being disposed at the lower end of the accommodating opening 102;

said accommodating hood 30 being disposed at the external side of the upper middle section, and a guiding groove that exactly corresponds to the accommodating groove 103 of the casing 10, and a pair of rotary arms 302 being extended inward from the lateral sides of the top of the guiding groove 301, and a transversal axial rod 303 being disposed between the two rotary arms 302. In addition, at least one latches being exactly latched to the latch 304 of the latch groove 105 of the casing 10;

said triggering member 40 being disposed between the guiding groove 301 of the accommodating hood 30 and the accommodating groove 103 of the casing 10, and being arranged as in the shape of the letter "I" in a horizontal position, in which a vertical triggering panel 401 being disposed at the upper end, and a vertical blocking panel 402 being disposed at the lower end, and a pair of transversal position latch 403, 404 with longer length adjacent to the upper end than that adjacent to the lower end; wherein the transversal positioning latch 403 adjacent to the upper end exactly latches the transversal axial rod 303 at the upper end of the accommodating hood 30, and the transversal positioning latch 404 adjacent to the lower end exactly latches into transversal axial rod 104 at the seam of the accommodating opening 102 of the casing 10 and the accommodating groove 103, such that the accommodating hood 30 is coupled to the casing 10 by the assembling. Two transversal axial rods 303, 304 separately act as the rotation axial points, being disposed at the position of the accommodating opening 102 for up and down swinging movement.

Figure 6:
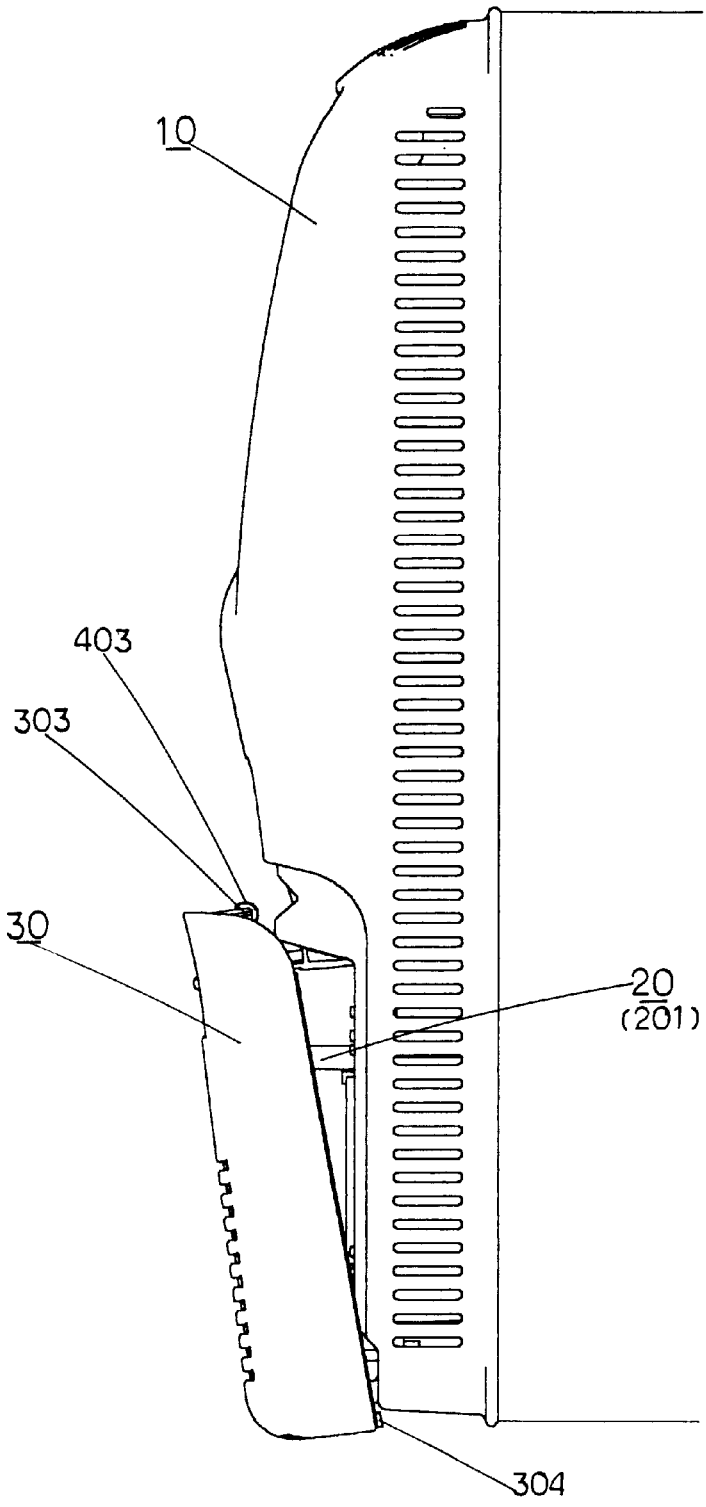
FIG. 6 shows a planar schematic diagram of the accommodating hood in non-closed position according to the present invention.
Figure 7:
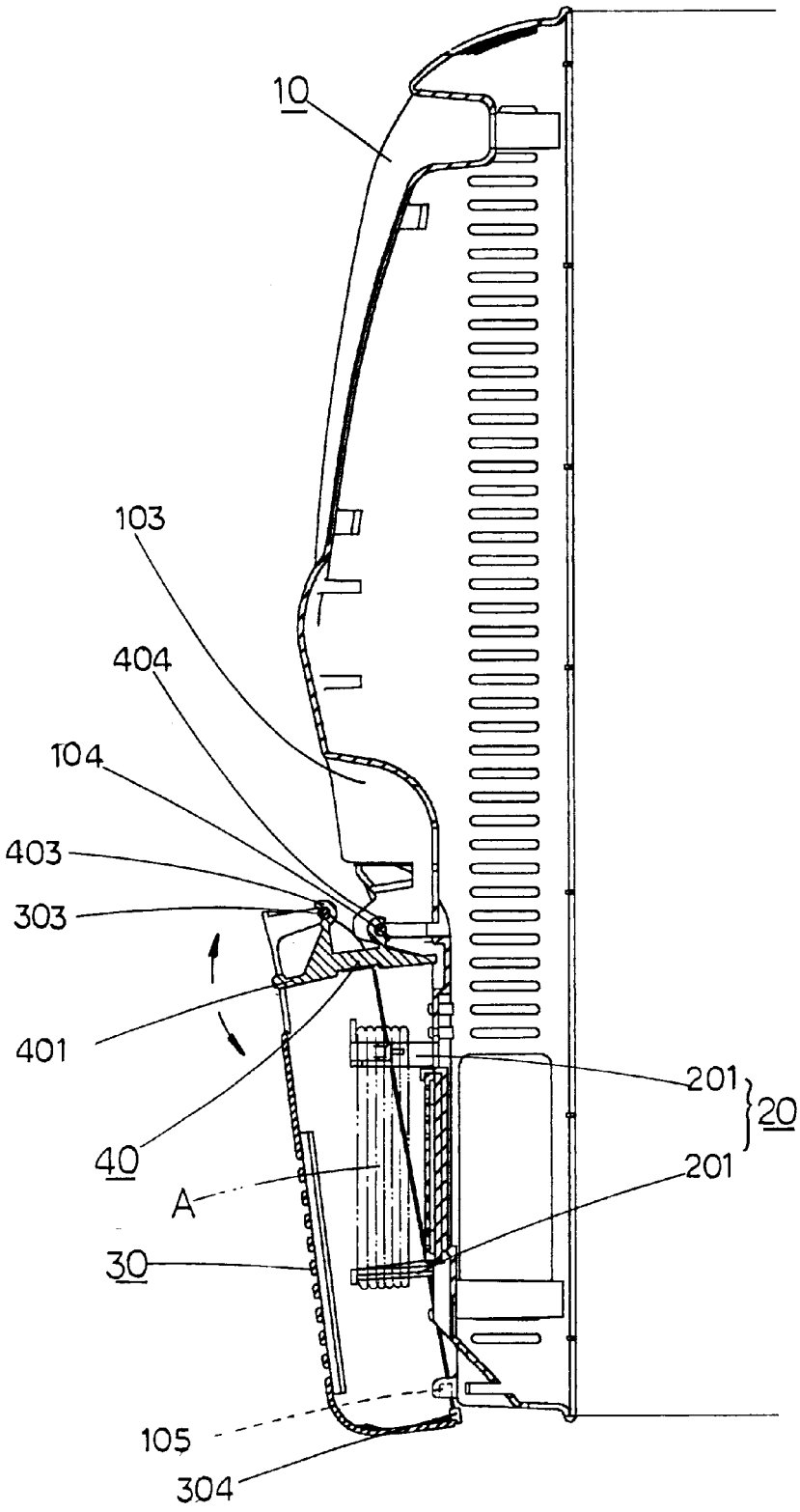
FIG. 7 is the cross-sectional schematic diagram of FIG. 6.
Figure 8:
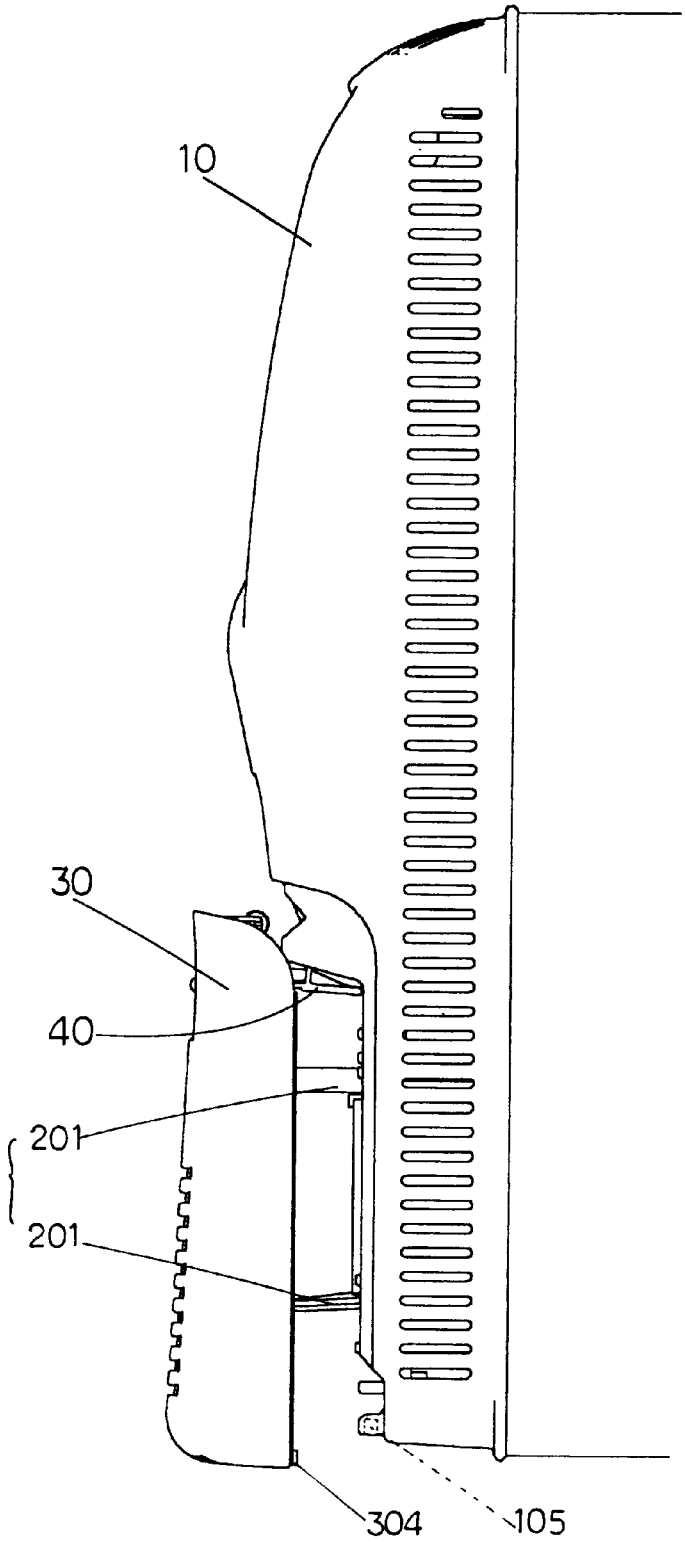
FIG. 8 shows a planar schematic diagram of the accommodating hood in open position according to the present invention.
Figure 9:
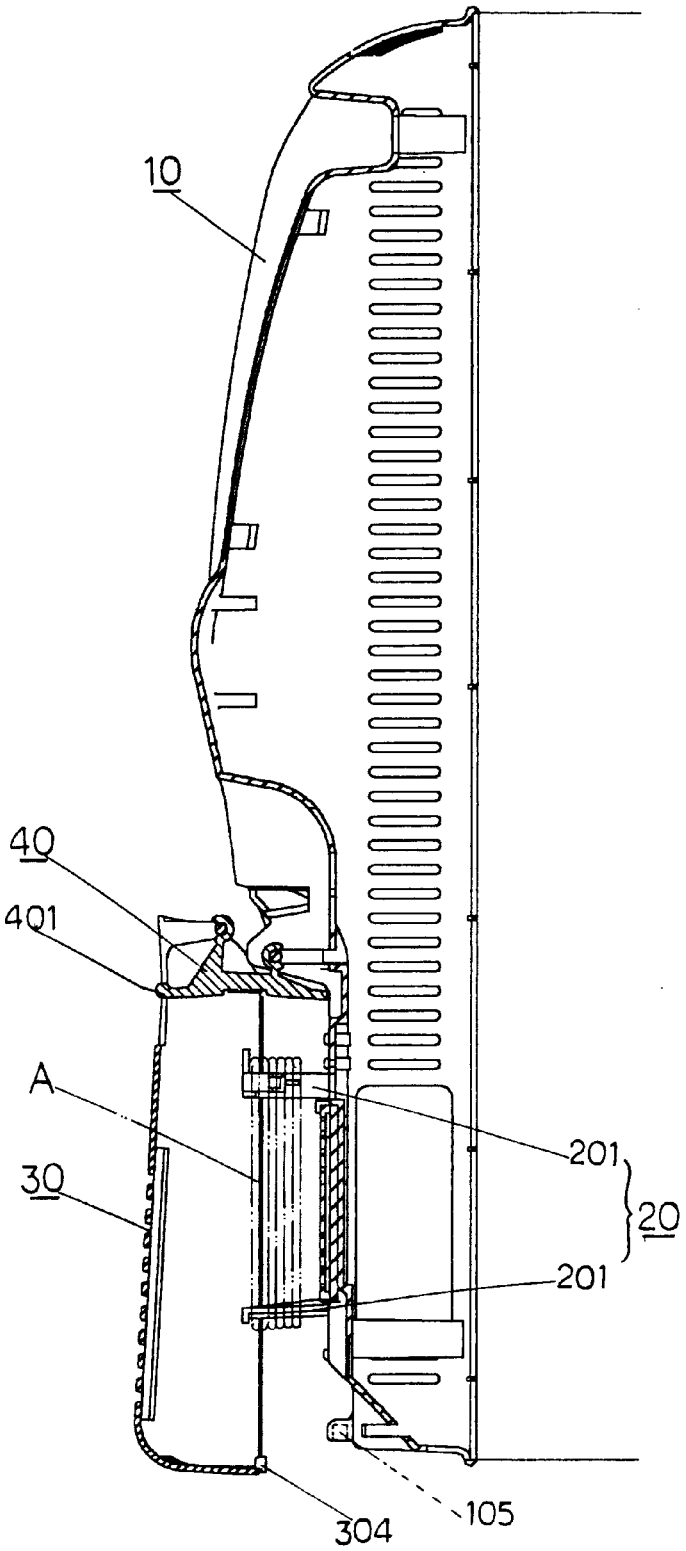
FIG. 9 is the cross-sectional schematic diagram of FIG. 8.
Figure 10:
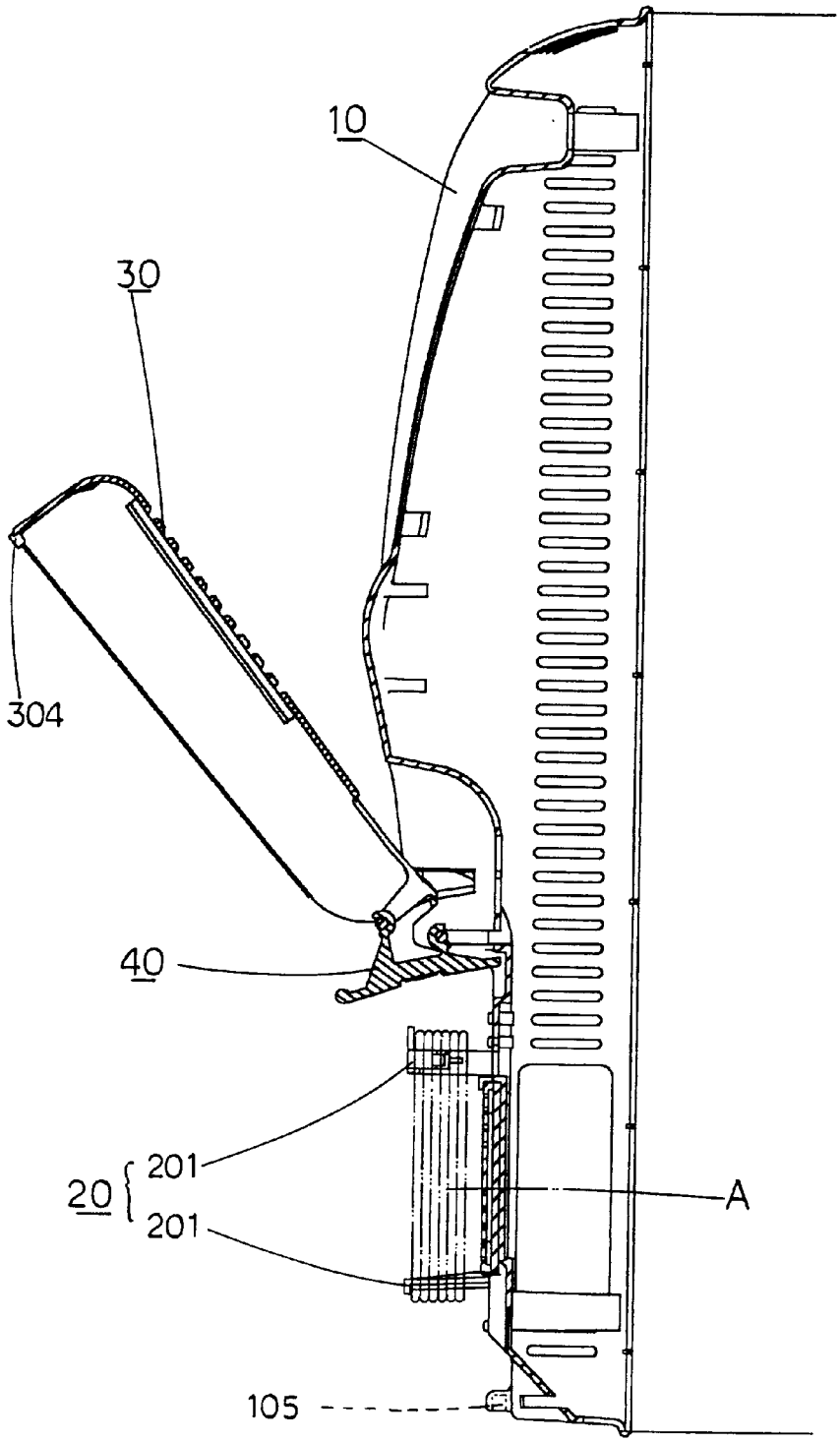
FIG. 10 shows a cross-sectional schematic diagram of the accommodating hood in a lifted position according to the present invention.

Further, refer to FIGS. 6, 7, 8, 9, and 10, the structure of the present invention as disclosed above comprises an accommodating opening 102 being designed to disposed in the concave inward status at the cable outlet 101 of the electric heater casing 10, and an accommodating hood 30 which exactly covers the accommodating opening 102 according to the shape of the casing so that the cable coiling frame composed of a plurality of supporting legs 201 being disposed at the accommodating opening 102. It exactly occupies the position in a simple way that does not occupy extra space, and at the same time with the covering of the accommodating hood 30 can hide the coiled cable A (please refer to FIG. 5) giving an artistic look (please refer to FIG. 4), and the cable will not fall off easily that provides a safe and secure way for collecting the cables. Of course, it also gives a harmonic, consistent look for the overall appearance of the electric heater, and improves the traditional exposed cable coiling frame by preventing the users from the danger of being injured easily by the exposed frame.

The "I" shaped triggering member 40 is disposed adjacent to the lower end of the transversal positioning latch 404 being freely pivotally latched to the transversal axial rod 104 of the casing 10, and another transversal positioning latch 403 being freely pivotally latched to the transversal axial rod 303 of the accommodating hood 30. In addition, the vertical triggering panel 401, the vertical blocking panel 402 at the upper end and lower end respectively locate between the accommodating groove 103 of the casing 10 and the guiding groove 301 of the accommodating hood 30. Therefore, when the user moves the vertical triggering panel 401 of the triggering member 40 at the accommodating groove 103 of the casing 10, the triggering member 40 will use the transversal axial rod 104 of the casing 10 as the axial point for the up and down swinging movement (please refer to FIGS. 2, 3, 5, and 7). At the same, the transversal axial rod 303 is latched to the accommodating hood 30 of the longer transversal latch positioning latch 403. As the triggering member 40 swings, it links to move the transversal axial rod 303 up and down.

Further, since the triggering member 40 has a transversal position latch 403 at its adjacent upper end is set to be longer than the transversal positioning latch 404 at the adjacent lower end, and a latch 304 is disposed at the inner edge of the lower end of the accommodating hood 30 and also set to be exactly inserted into the latch groove 105 of the lower end of the casing 10. Therefore, the user can aim the latch 304 at the lower end of the freely swung accommodating hood 30 at the latch groove 105 at the lower end of the corresponding casing 10. When the vertical triggering panel 401 of the triggering member 40 is lifted upward (please refer to FIGS. 5 and 7), the latch 304 at the lower end of the accommodating hood 30 can be inlaid into the latch groove 105 of the casing 10. Meanwhile, the triggering member 40 adjacent to the upper end has a longer transversal positioning latch 403 will guide the transversal axial rod at the upper end of the accommodating hood 30 inside, and passes the vertical line Y of the transversal axial rod 104 of the casing 10 (please refer to FIG. 5), and it will automatically press inward instantly to securely latch into a stable position.

If the user wants to open the accommodating hood 30, the user just needs to move the vertical triggering panel 401 at the upper end of the triggering member 40 outward and downward (please refer to FIGS. 7, 8, and 9), and the upper end of the accommodating hood 30 will be linked to move outward and downward, and the originally inlaid latch 304 of the accommodating hood in the latch groove 105 of the casing will displace downward directly and smoothly until it releases the latch. Then the transversal axial rod 303 at the upper end of the accommodating hood 30 is rotated freely at the transversal positioning latch 403 of the triggering member 40, and then the user can lift the bottom end of the accommodating hood 30 upward (see FIGS. 8, 9, and 10) such that the entire accommodating hood 30 is in the open position, and then the power cable A can be coiled onto the cable coiling frame 20 smoothly and conveniently. Of course, after the power cable is coiled completed, the user can press the accommodating hood down to hide the cable coiling frame 20 and the power cable A inside, and then latch the latch 304 at the lower end of the accommodating hood 30 into the latch groove 105 at the lower end of the casing 10, and the triggering member 40 is pressed upward and inward so that the accommodating hood 30 is securely coupled to the casing 10. The present invention can definitely improve the shortcomings of the traditional exposed cable coiling frame.

Therefore, in summation of the above description, the improved structure is the research and development subject for enhancement. The inventor of the present invention based on years of experience in the related industry conducted extensive research to enhance the structure of the storage rack herein which is hereby submitted for patent application.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An improved cable collecting device for electric heaters comprises:

a casing, comprising a concave accommodating opening being disposed at an outlet of a power cable, and an accommodating groove being extended upward from substantially the central section of the upper end of the accommodating opening, and a transversal axial rod being disposed at the seam of the accommodating opening and the accommodating groove, and at least one latch groove being disposed at the lower end of the accommodating opening;

a cable coiling frame being disposed at the accommodating opening of the casing;

an accommodating hood is being designed according to the appearance of the casing and covers the accommodating opening of the casing, and a guiding groove being disposed at a position corresponsive to the accommodating groove of the casing, and a corresponding rotary arm being disposed each on the lateral sides of the guiding groove and an axial rod being transversally disposed between the two rotary arms, and at least one latch for latching into the latch groove of the casing being disposed at the bottom of the internal side;

a triggering member for mutually coupling the assembly of the accommodating hood and the casing, which is in shape of a letter "I" in horizontal position, and a vertical triggering panel being disposed at the upper end, and a vertical blacking panel being disposed at the lower end, and a positioning latch having a longer length at the upper portion than that of the lower portion being disposed at the position adjacent to the upper end and the lower end respectively, which being freely pivotally coupling to the transversal axial rod, and the transversal position latch at the lower end being freely pivotally latched to the transversal axial rod where the accommodating opening of the casing and the accommodating groove couple; wherein the foregoing arrangement composes an improved cable collecting device for electric heaters.

* * * * *